US006731190B2

(12) United States Patent
Yamashita et al.

(10) Patent No.: US 6,731,190 B2
(45) Date of Patent: May 4, 2004

(54) ELECTROMAGNETIC RELAY

(75) Inventors: Takeshi Yamashita, Tokyo (JP); Shigemitsu Aoki, Tokyo (JP)

(73) Assignee: Takamisawa Electric Co., Ltd., Tokyo (JP)

( * ) Notice: Subject to any disclaimer, the term of this patent is extended or adjusted under 35 U.S.C. 154(b) by 185 days.

(21) Appl. No.: 10/066,661

(22) Filed: Feb. 6, 2002

(65) Prior Publication Data

US 2002/0109569 A1 Aug. 15, 2002

(30) Foreign Application Priority Data

Feb. 9, 2001 (JP) ..... 2001-034445

(51) Int. Cl.[7] ..... H01F 51/22; H01F 5/00
(52) U.S. Cl. ..... 335/78; 335/282
(58) Field of Search ..... 335/78–86, 282, 335/299; 336/192

(56) References Cited

U.S. PATENT DOCUMENTS 6,486,760 B2 * 11/2002 Miyazaki et al. ..... 335/78

FOREIGN PATENT DOCUMENTS

JP 5-15285 2/1993

JP 2000-182496 6/2000

* cited by examiner

*Primary Examiner*—Ramon M. Barrera
(74) *Attorney, Agent, or Firm*—Arent Fox PLLC

(57) ABSTRACT

An electromagnetic relay including a base, an electromagnet incorporated to the base, an armature movably arranged relative to the electromagnet, and a contact section incorporated to the base to be actuated by the armature. The electromagnet includes a bobbin, a coil having a center axis and carried on the bobbin, and a pair of coil terminals mounted to the bobbin. Each of the coil terminals is provided with a first end region and a second end region, extending in respective directions transverse to each other. The coil terminals are disposed in such a manner that respective first end regions extend in a direction transverse to the center axis of the coil to project outward from the bobbin and are arranged side-by-side in a row extending substantially parallel to the center axis, and that respective second end regions extend in a direction parallel to the center axis of the coil to project outward from the bobbin and are arranged side-by-side in a row extending substantially transverse to the center axis. The opposite wire ends of the coil are connected respectively to the second end regions.

8 Claims, 12 Drawing Sheets

ELECTROMAGNETIC RELAY

BACKGROUND OF THE INVENTION

1. Field of the Invention

The present invention relates generally to a relay, and more particularly to an electromagnetic relay having a thinner profile.

2. Description of the Related Art

In a conventional electromagnetic relay, an electromagnet incorporated therein has a general construction wherein a conductive wire is wound to form a coil on a bobbin, as an electrical insulator, with an iron core held therein and the opposite ends of the wire are respectively connected to a pair of coil terminals mounted to the bobbin. In this type of electromagnetic relay, it is known that the coil terminals in the electromagnet are arranged side-by-side in a row extending substantially parallel to the center axis of the coil, and that fixed and movable contact plates forming a make/break contact section in the vicinity of the electromagnet are also arranged side-by-side in a row extending along the coil center axis (see, e.g., Japanese Unexamined Patent Publication (Kokai) No.2000-182496). This arrangement makes it possible to reduce the outside dimension of the electromagnetic relay in, especially, a width direction transverse to the coil center axis, and thus facilitates the reduction in thickness (or width dimension) of the relay.

When the electromagnetic relay having such a thinner profile is produced through the above-described winding process, the end regions of the coil terminals mounted to the bobbin, to which the wire opposite ends are entwined to be mechanically and electrically connected, are previously located at positions allowing the wire ends being readily entwined thereto, i.e., at accessible positions extending transverse to the longitudinal axis of the body of the bobbin so as to project laterally outward from the bobbin. In the winding process, one end of the conductive wire is entwined around the entwining end region of one coil terminal located in the accessible position, so as to be temporarily held thereon. Then, the desired length of the conductive wire is wound around the body of the bobbin to form the coil. Thereafter, another end of the conductive wire is entwined around the entwining end region of another coil terminal located in the accessible position, so as to be temporarily held thereon. Then, the wire opposite ends, temporarily held on the entwining end regions of both coil terminals, are fixed through a soldering or welding process to the corresponding entwining end regions. Finally, the coil terminals are deformed to displace or turn up the entwining end regions from the accessible positions to finished positions where the entwining end regions extend along the lateral side of the coil so as not to project outward from the bobbin. According to this procedure, it is possible to surely perform the winding process and to meet the requirements of a dimensional restriction in, especially, the transverse or width direction of the electromagnetic relay.

However, in the above winding process, a worker's skill is required for deforming the coil terminals to displace or turn up the entwining end regions, to which the wire ends have been securely connected, from the accessible positions to the finished positions, which may result in increased production costs. In particular, the displacement of the entwining end regions from the accessible positions to the finished positions may generate an excessive tensile stress in the opposite end lengths of the conductive wire, extending between the coil and the entwining end regions, or may result in a loosening in the opposite end lengths of the wire. This excessive tensile stress or loosening in the opposite end lengths of the conductive wire may resultantly cause a breakage of the wire. Also, in a case where the wire ends are fixed to the entwining end regions of the coil terminals through an arc welding, it may be difficult to correctly deform the coil terminals to turn up the entwining end regions into the finished positions after the welding is completed. Therefore, in this case, a soldering is normally performed for fixing the wire ends, which however goes against the general requirements of reduction of solder in manufacturing processes.

Incidentally, in the conventional electromagnetic relay having a thinner profile, a yoke for forming a magnetic path around the coil is securely joined to one axial end of the iron core received in the bobbin, and an armature connected to the yoke through a plate spring in an elastically shiftable manner is disposed to be opposed to another axial end of the iron core, so as to constitute a magnetic-circuit assembly. The magnetic-circuit assembly is then securely mounted to a base as an electrical insulator which in turn supports the fixed and movable contact plates. For this conventional mounting work, the base is provided with a protrusion at a predetermined position while the yoke is provided with a groove capable of tightly receiving the protrusion of the base, and the yoke is press-fitted to the base so as to securely mount the magnetic-circuit assembly to the base.

However, in this structure, a cross-sectional area of the yoke as a magnetic path is reduced at the groove, and thereby a magnetic flux is decreased, which may result in the degradation of magnetic attraction force of the electromagnet and may cause the unstable make/break operation of the electromagnetic relay. If the dimensions of both of the groove in the yoke and the mating protrusion in the base are reduced to solve the above problem, the mounting strength of the magnetic-circuit assembly to the base as well as the structural reliability of the electromagnetic relay may be deteriorated.

SUMMARY OF THE INVENTION

It is therefore an object of the present invention to provide an electromagnetic relay having a thinner profile, capable of simplifying a winding process for forming a coil in an electromagnet, while meeting the requirements of a dimensional restriction in, especially, the transverse or width direction of the relay.

It is another object of the present invention to provide an electromagnetic relay having a thinner profile, capable of significantly eliminating the possibility of breakage of a conductive wire of a coil, so as to ensure a high structural reliability.

It is still another object of the present invention to provide an electromagnetic relay, capable of meeting the general requirements of reduction of solder in manufacturing processes.

It is still another object of the present invention to provide an electromagnetic relay, capable of securely mounting a magnetic-circuit assembly to a base without reducing the cross sectional area of a magnetic path, so as to possess stable operating characteristics and a high structural reliability.

In accordance with the present invention, there is provided an electromagnetic relay comprising a base; an electromagnet incorporated to the base; an armature movably arranged relative to the electromagnet; and a contact section incorporated to the base to be actuated by the armature; the electromagnet including a bobbin, a coil having a center axis and carried on the bobbin, and a pair of coil terminals mounted to the bobbin; each of the coil terminals being provided with a first end region and a second end region, extending in respective directions transverse to each other; the coil terminals being disposed in such a manner that respective first end regions extend in a direction transverse to the center axis of the coil to project outward from the bobbin and are arranged side-by-side in a row extending substantially parallel to the center axis, and that respective second end regions extend in a direction parallel to the center axis of the coil to project outward from the bobbin and are arranged side-by-side in a row extending substantially transverse to the center axis; opposite wire ends of the coil being connected respectively to the second end regions.

In this electromagnetic relay, it is preferred that each of the coil terminals is further provided with an intermediate length extending between the first and second end regions, the intermediate length being closely embedded in and integrally fixed to the bobbin.

The coil terminals may have lengths different from each other.

The second end regions of the coil terminals may extend in respective orientations opposite to each other in relation to corresponding first end regions.

The first and second end regions of the coil terminals may extend in respective directions orthogonal to each other.

It is advantageous that the contact section includes a fixed contact plate and a movable contact plate; the fixed contact plate and the movable contact plate being provided respectively with end regions extending in a direction transverse to the center axis of the coil to project outward from the base; the end regions of the fixed and movable contact plates being arranged side-by-side in a row extending substantially parallel to the center axis and aligned to the row of the first end regions of the coil terminals.

The electromagnet may further include an iron core received in the bobbin and disposed along the center axis of the coil, and the electromagnetic relay may further comprise a yoke securely joined to the iron core to form a magnetic path around the coil; the yoke being provided with a protrusion tightly engaged with the base; the electromagnet being fixedly mounted to the base through an interengagement of the protrusion with the base in a press-fitting manner.

The present invention also provides an electromagnetic relay comprising a base; an electromagnet incorporated to the base; a yoke securely joined to the electromagnet to form a magnetic path; and an armature movably supported on the yoke; the yoke being provided with a protrusion tightly engaged with the base; the electromagnet being fixedly mounted to the base through an interengagement of the protrusion with the base in a press-fitting manner.

The present invention also provides an electromagnetic relay comprising an electromagnet including a bobbin, a coil having a center axis and carried on the bobbin, and a pair of coil terminals mounted to the bobbin; each of the coil terminals being provided with a first end region and a second end region, extending in respective directions transverse to each other; the coil terminals being disposed in such a manner that respective first end regions extend in a direction transverse to the center axis of the coil to project outward from the bobbin and are arranged side-by-side in a row extending substantially parallel to the center axis, and that respective second end regions extend in a direction parallel to the center axis of the coil to project outward from the bobbin and are arranged side-by-side in a row extending substantially transverse to the center axis; opposite wire ends of the coil being connected respectively to the second end regions.

BRIEF DESCRIPTION OF THE DRAWINGS

The above and other objects, features and advantages of the present invention will become more apparent from the following description of preferred embodiments in connection with the accompanying drawings, in which.

DESCRIPTION OF THE PREFERRED EMBODIMENT

Figure 1:
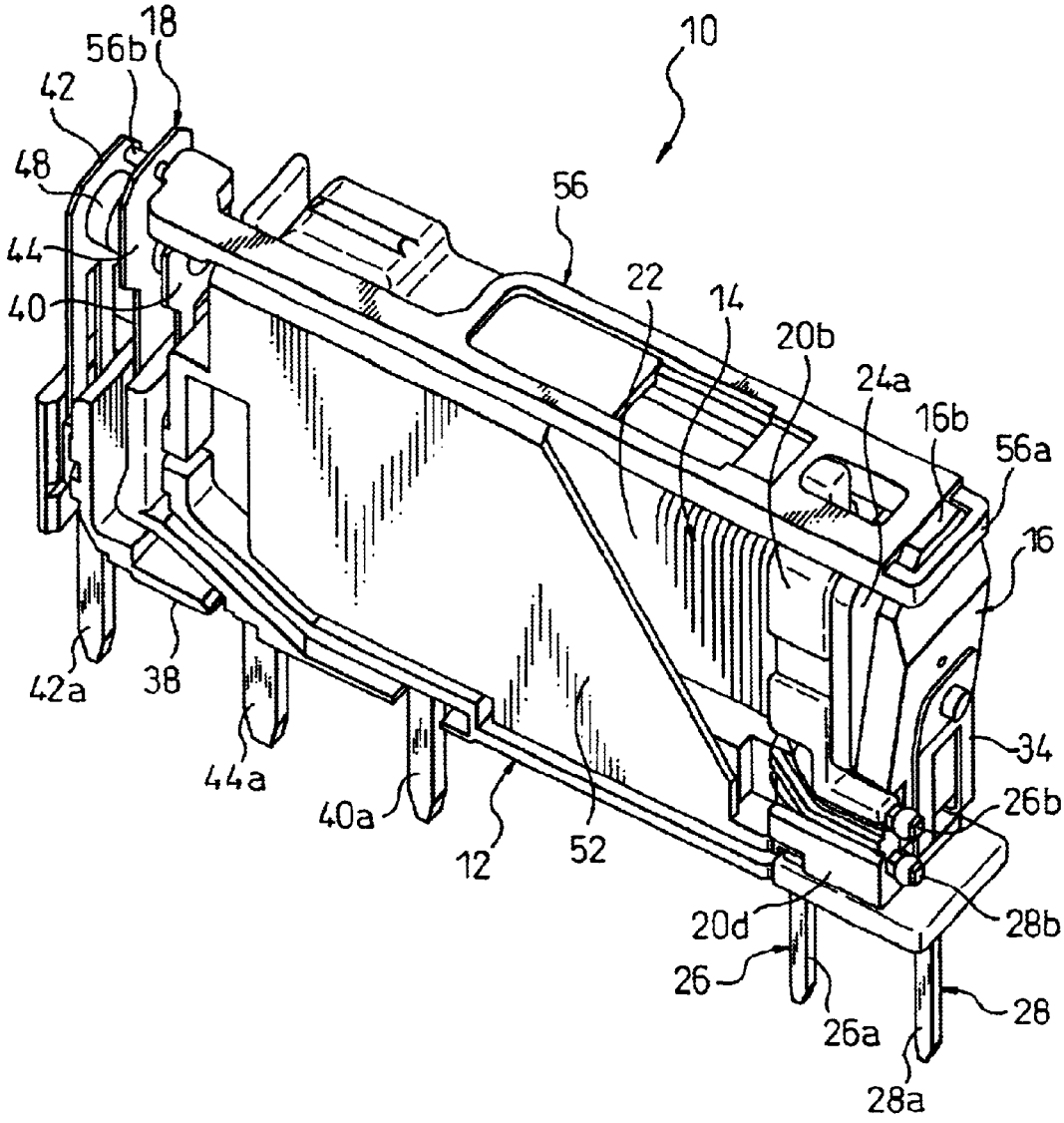
FIG. 1 is a perspective view showing an electromagnetic relay, according to an embodiment of the present invention, from one side thereof.
Figure 2:
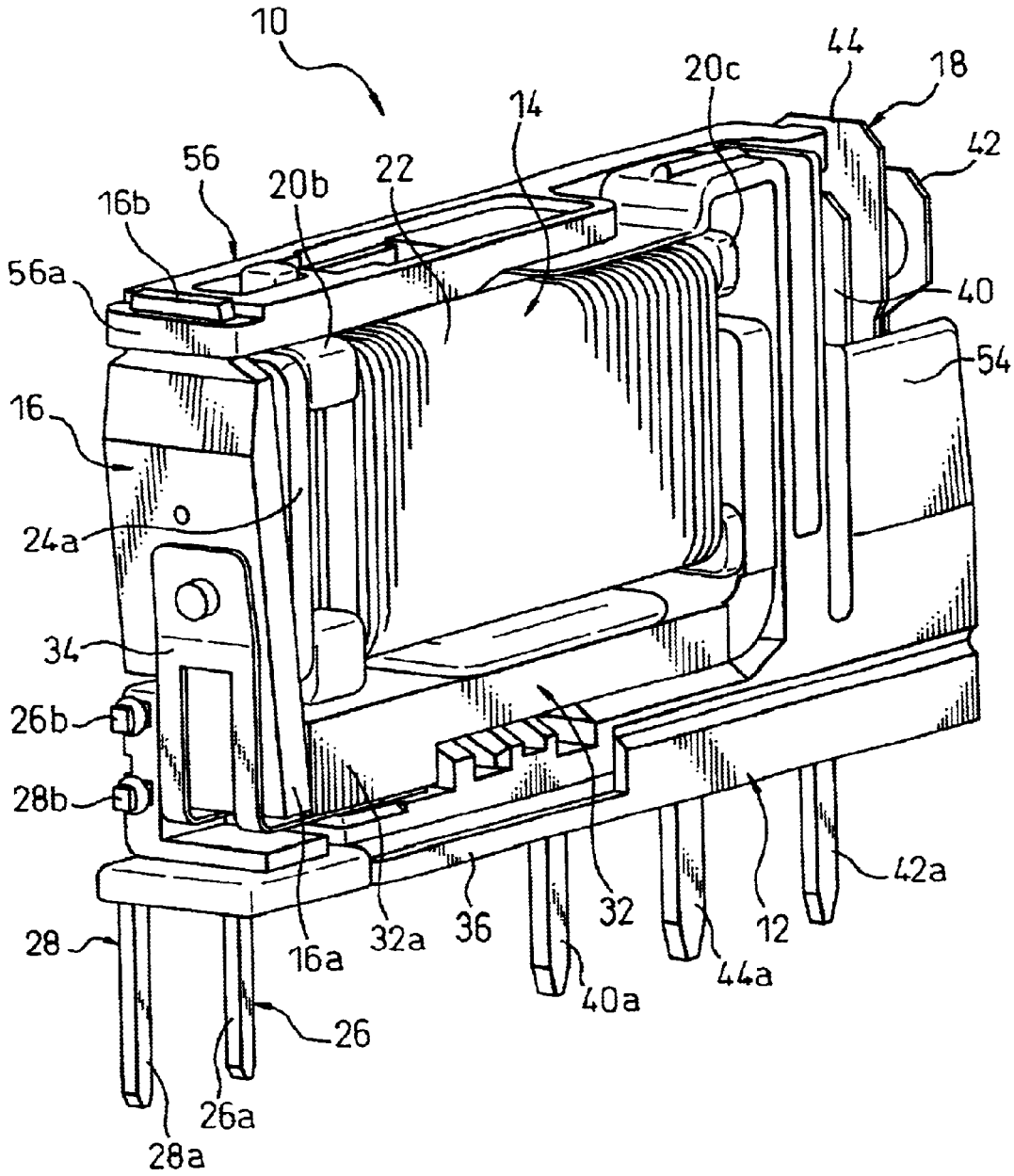
FIG. 2 is a perspective view showing the electromagnetic relay of FIG. 1 from another side thereof.

Referring now to the drawings, in which the same or similar components are denoted by common reference numerals, FIGS. 1 and 2 show an electromagnetic relay 10, according to an embodiment of the present invention, in mutually different orientations. As illustrated, the electromagnetic relay 10 includes a base 12, an electromagnet 14 incorporated with the base 12, an armature 16 shiftably supported on the electromagnet 14 and adapted to be driven by the electromagnet 14, and a contact section 18 incorporated with the base 12 to be actuated by the armature 16 as the armature is shifted on the electromagnet 14. The base 12 is formed from an electrically insulating resinous mold, onto which a magnetic-circuit assembly, as described later, is mounted. The contact section 18 is supported on the base 12 in the vicinity of the magnetic-circuit assembly.

Figure 3:
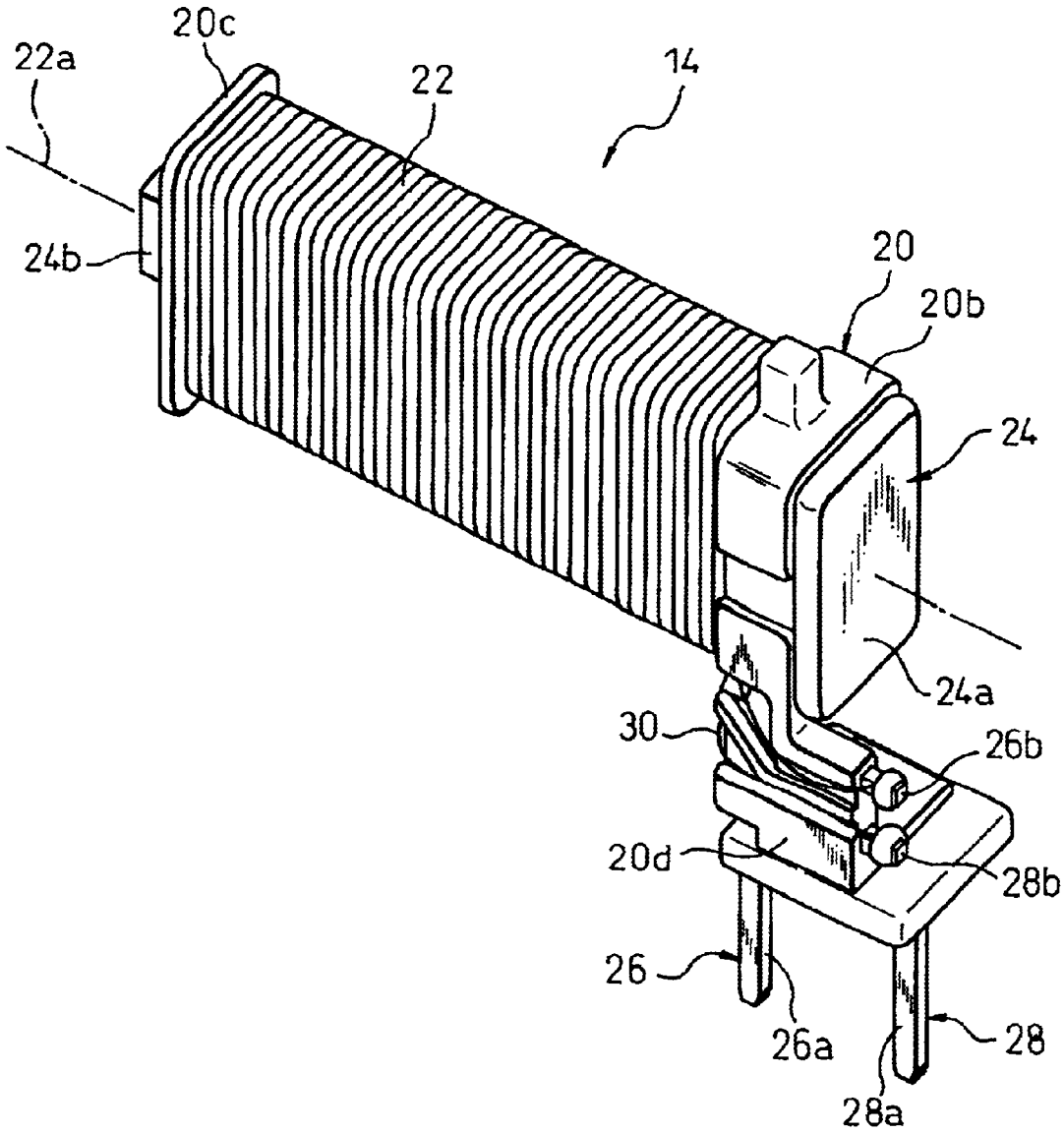
FIG. 3 is a perspective view showing an electromagnet incorporated in the electromagnetic relay of FIG. 1.
Figure 4:
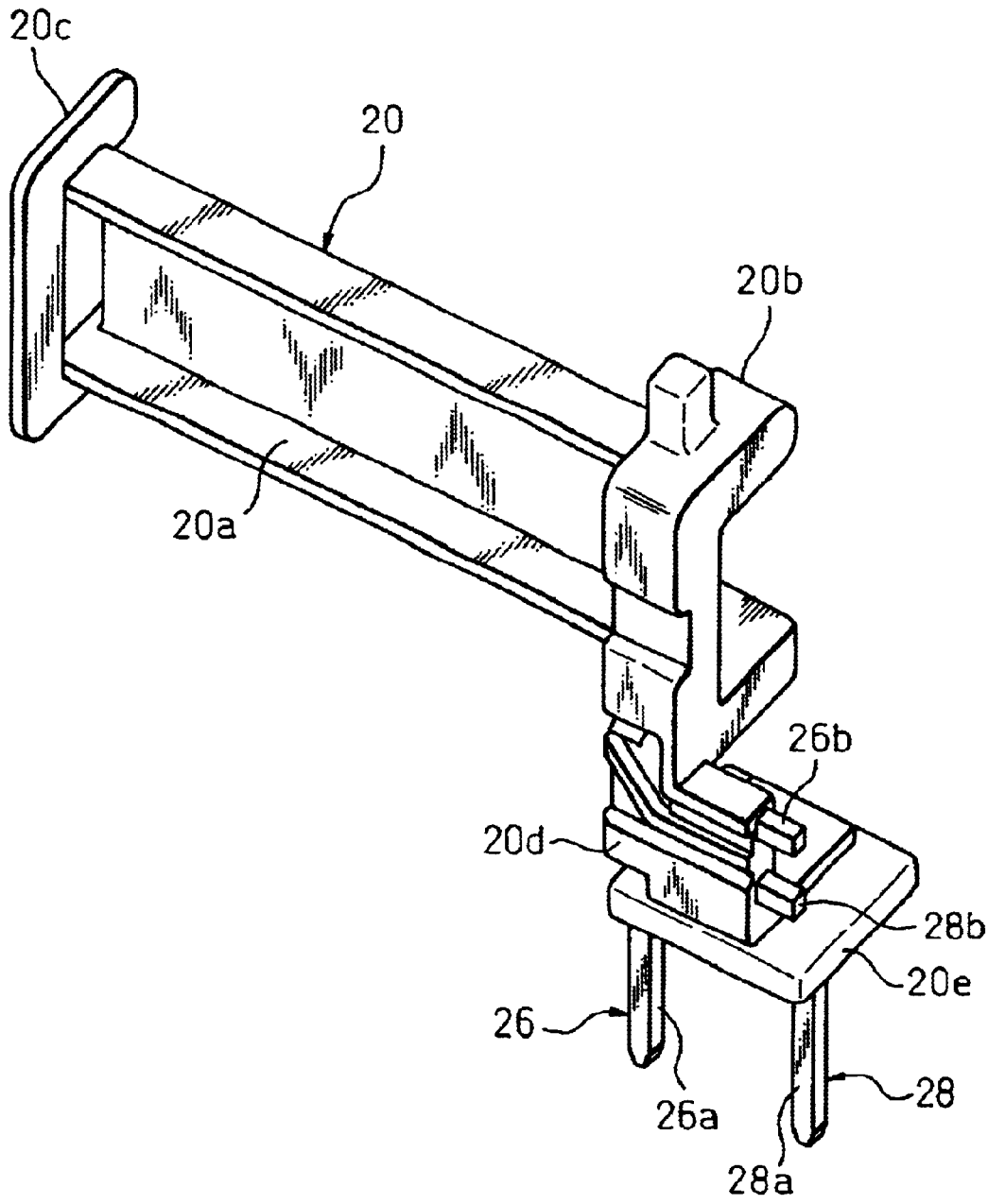
FIG. 4 is a perspective view showing a bobbin in the electromagnet of FIG. 3 from one side thereof.
Figure 5:
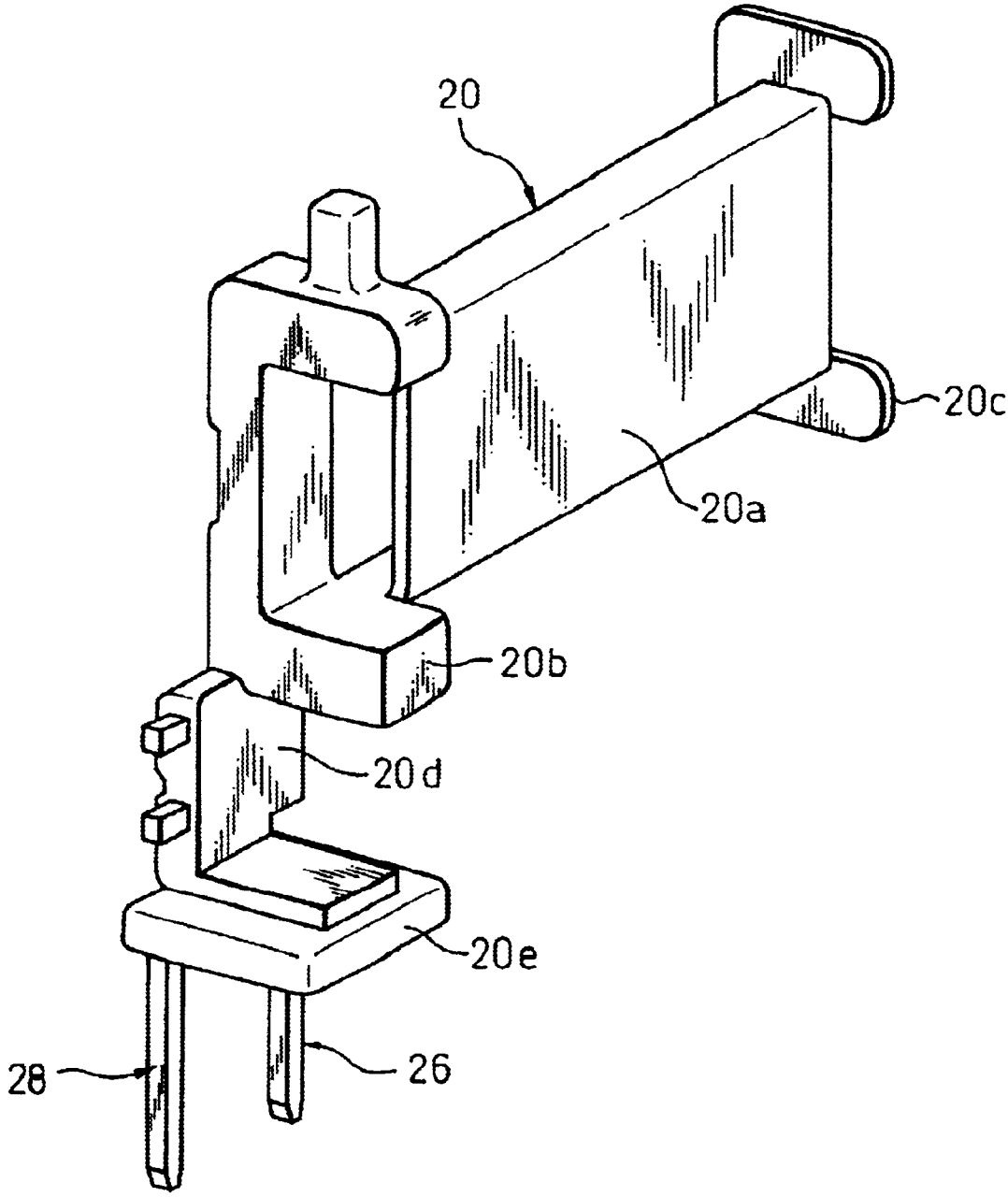
FIG. 5 is a perspective view showing the bobbin of FIG. 4 from another side thereof.

As shown in FIG. 3, the electromagnet 14 includes a bobbin 20, a coil 22 having a center axis 22*a* and carried on the bobbin 20, and an iron core 24 supported on the bobbin 20 to be disposed along the center axis 22*a* of the coil 22. The bobbin 20 is formed from an electrical insulating resinous mold. As shown in FIGS. 4 and 5, the bobbin 20 is provided integrally with a body 20*a* having a U-shaped sectional profile and linearly extending over a predetermined length, a pair of C-shaped flanges 20*b*, 20*c* formed respectively at the longitudinal opposite ends of the body 20*a*, a terminal support 20*d* extending from one flange 20*b* in a direction transverse to the longitudinal axis of the body 20*a*, and a bottom wall 20*e* extending from the terminal support 20*d* in a direction generally orthogonal to the terminal support 20*d* at a location below the flange 20*b*. A pair of coil terminals 26, 28, formed from good electrical conductors, are securely mounted onto the terminal support 20*d* of the bobbin 20 in such a configuration that the terminal end regions 26*a*, 28*a* thereof, projecting from the bottom wall 20*e*, are arranged side-by-side in a row extending substantially parallel to the longitudinal axis of the body 20*a*, i.e., the center axis 22*a* of the coil 22.

The coil 22 is formed by winding a predetermined length of a conductive wire 30 tightly onto the body 20*a* of the bobbin 20, and is securely held between the flanges 20*b*, 20*c* of the bobbin 20. The conductive wire 30 forming the coil 22 is connected at the opposite ends thereof with the coil terminals 26, 28 mounted onto the terminal support 20*d* of the bobbin 20 (see FIG. 3).

The iron core 24 is a bar-shaped member formed by, e.g., punching a magnetic steel plate into a predetermined shape. The major part of the iron core 24 is fixedly received within the U-shaped body 20*a* of the bobbin 20. As shown in FIG. 3, the iron core 24 is provided at one axial end thereof with a head 24*a* having a flat end face, and the head 24*a* is exposed outside of the flange 20*b* of the bobbin 20. Also, the other axial end 24*b* of the iron core 24 projects outward from the other flange 20*c* of the bobbin 20.

Figure 6:
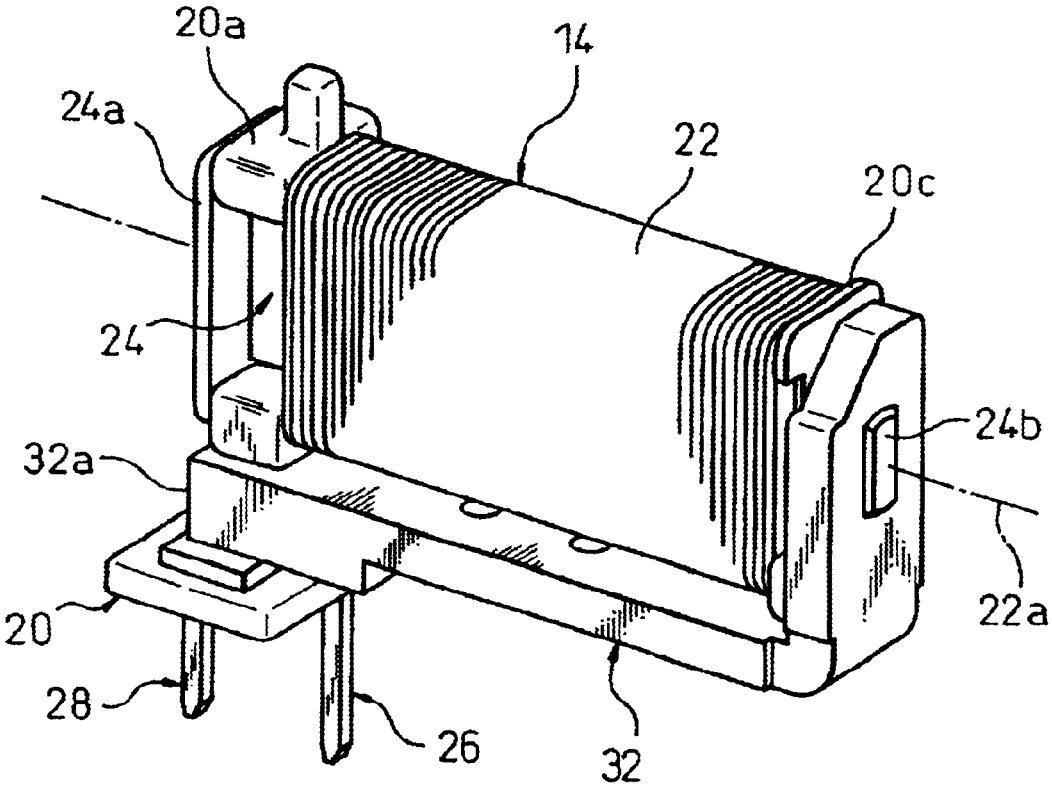
FIG. 6 is a perspective view showing the electromagnet of FIG. 3 with a yoke being joined thereto.

A yoke 32 is fixedly joined to the other axial end 24*b* of the iron core 24 through, e.g., a caulking or a plastic deformation of the material of the core 24, so as to form a magnetic path or circuit around the coil 22 (see FIG. 6). The yoke 32 is a plate-like member formed by, e.g., punching a magnetic steel plate into a predetermined shape and bending the punched plate into an L-shape. The yoke 32 is arranged so that the shorter length part (32*c*, in FIG. 11A) thereof extends along the flange 20*c* of the bobbin 20 and the longer length part (32*b*, in FIG. 11A) thereof extends along the coil 22 in generally parallel to the coil center axis 22*a* so as to be spaced from the coil 22. The free end 32*a* of the longer length part of the yoke 32 is located close to the head 24*a* of the iron core 24, and the armature 16 is pivotably connected to the free end 32*a* as described below.

The armature 16 is a plate-like member formed by, e.g., punching a magnetic steel plate into a predetermined shape. The armature 16 is connected through an L-shaped plate spring 34 to the yoke 32 in an elastically shiftable manner relative to the yoke 32, and is disposed oppositely to the head 24*a* of the iron core 24 (FIG. 2). The plate spring 34 acts as an elastic hinge between the yoke 32 and the armature 16, and elastically biases or urges the armature 16 in a direction away from the head 24*a* of the iron core 24 due to an inherent spring action of the plate spring 34. The iron core 24 of the electromagnet 14, the yoke 32 and the armature 16, thus assembled together under a predetermined correlation therebetween, constitute the magnetic-circuit assembly which contributes to the establishment of a magnetic circuit during a period when the electromagnet 14 is operated or excited.

The armature 16 is abutted at one end (the bottom end, in the drawing) 16*a* thereof onto the free end 32*a* of the yoke 32 under the spring or biasing force of the plate spring 34, so that, during a period when the electromagnet 14 is not excited, the armature 16 is held in a stationary state at an initial or released position (FIG. 1) spaced away from the head 24*a* of the iron core 24 at a predetermined distance. When the electromagnet 14 is excited, the armature 16 is shifted or pivoted toward the core head 24*a* against the biasing force of the plate spring 34 due to a magnetic attraction force, about a mutually engaging point between the armature bottom end 16*a* and the yoke free end 32*a*.

Figure 7:
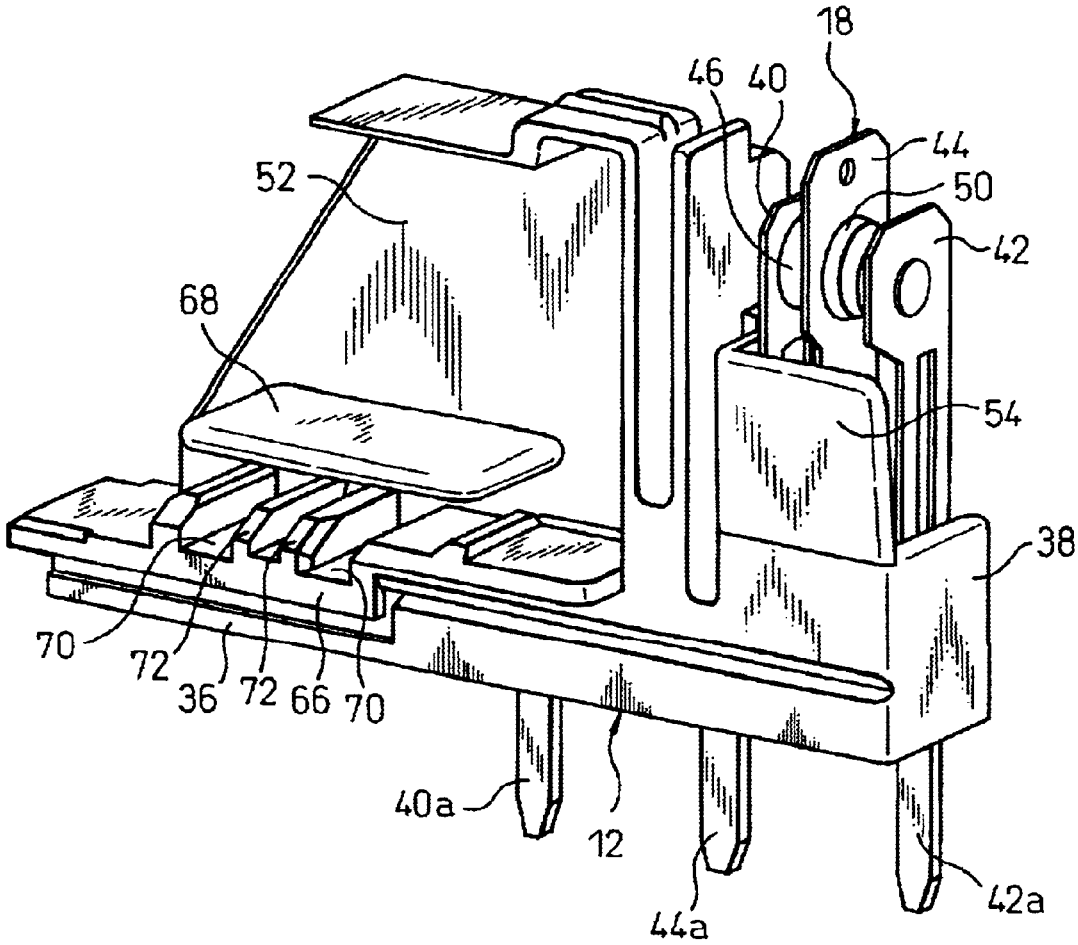
FIG. 7 is a perspective view showing a base and a contact section, both incorporated in the electromagnetic relay of FIG. 1.

The base 12 includes a first portion 36 for the installation of the electromagnet 14 and the magnetic-circuit assembly and a second portion 38 for the installation of the contact section 18 (see FIGS. 1, 2 and 7). The contact section 18 includes a pair of fixed contact plates 40, 42 arranged side-by-side along the center axis 22*a* of the coil 22 of the electromagnet 14 and spaced at a predetermined distance from each other, and a movable contact plate 44 arranged between the fixed contact plates 40, 42 and spaced at a predetermined distance from the latter. Each of the fixed contact plates 40, 42 is a conductive plate member formed by, e.g., punching a copper plate into a predetermined shape. Also, the movable contact plate 44 is a conductive plate member formed by, e.g., punching a spring sheet of phosphor bronze into a predetermined shape. The first portion 36 is separated or isolated from the second portion 38 in the base 12, through insulating walls 52, 54 integrally formed on the base 12, so as to ensure an effective insulation distance between one part including the electromagnet 14 and the magnetic-circuit assembly and the other part including the fixed contact plates 40, 42 and the movable contact plate 44.

The fixed contact plates 40, 42 and the movable contact plate 44 are securely fitted at the longitudinal intermediate regions thereof to the second portion 38 of the base 12. Also, the fixed contact plates 40, 42 and the movable contact plate 44 are provided in the free end regions thereof, extending upward from the base 12, with fixed contacts 46, 48 and a movable contact 50, respectively, which are bulged on the surfaces of the respective contact plates 40, 42, 44 in a mutually opposed arrangement for permitting the contacts 46, 48, 50 to come into selectively contact with each other. The fixed and movable contact plates 40, 42, 44 extend downward at the other end regions thereof from the base 12 to form terminal end regions 40*a*, 42*a*, 44*a*, respectively. The terminal end regions 40*a*, 42*a*, 44*a* are arranged side-by-side in a row extending substantially parallel to the center axis 22*a* (FIG. 3) of the coil 22 of the electromagnet 14. In the illustrated embodiment, the fixed contact plate 40 disposed close to the electromagnet 14 constitutes a break contact, and the fixed contact plate 42 disposed away from the electromagnet 14 constitutes a make contact.

The movable contact plate 44 is linked to the armature 16 through a link member 56 made of an electrical insulating material. The link member 56 is formed as an elongated plate integrally molded from, e.g., a resinous material. The link member 56 is joined at one longitudinal end 56*a* thereof to the free end (the upper end, in the drawing) 16*b* of the armature 16 at a location away from the yoke 32, and at another longitudinal end 56*b* to the free end (the upper end, in the drawing) of the movable contact plate 44 at a location away from the base 12. The link member 56 is moved to reciprocate in a direction substantially parallel to the coil center axis 22*a* (FIG. 3) in such a manner as to follow or interlock with the pivoting motion of the armature 16 caused by the excitation/de-excitation of the electromagnet 14, and thereby transmits the pivoting motion of the armature 16 to the movable contact plate 44 as described below.

In the initial or released position as shown in FIG. 1, the armature 16 is held to be spaced away from the head 24*a* of the iron core 24 at a predetermined distance, under the biasing force of the plate spring 34, as already described. In this state, the link member 56 is located at one limit position in the reciprocating range, so that the movable contact plate 44 joined to the other end 56*b* of the link member 56 is elastically bent or deformed toward the fixed contact plate 40 disposed near the electromagnet 14. In this manner, the movable contact 50 comes into contact with the fixed contact 46 so as to establish an electrical conduction therebetween, whereby the break contact is closed.

When the electromagnet 14 is excited, the armature 16 is pivoted or shifted from the released position of FIG. 1 toward the core head 24*a* against the biasing force of the plate spring 34 due to the magnetic attraction force, about the mutually engaging point between the armature bottom end 16*a* and the yoke free end 32*a*. The link member 65 is thereby moved toward another limit position in the reciprocating range, so as to elastically bend the movable contact plate 44 toward the fixed contact plate 42 disposed away from the electromagnet 14. At an instant when the armature 16 is completely absorbed on the core head 24*a*, the link member 56 reaches the other limit position in the reciprocating range, and the movable contact 50 comes into contact with the fixed contact 48 so as to establish an electrical conduction therebetween, whereby the make contact is closed.

The electromagnetic relay 10 as described above is capable of effectively reducing the outside dimension thereof in, especially, a width direction transverse to the coil center axis 22*a*. The electromagnetic relay 10 having such a thin profile adopts a characteristic arrangement, as described below, for simplifying a winding process of a conductive wire for forming a coil and thereby significantly eliminating the possibility of breakage of the coil wire, while meeting the requirement of a dimensional restriction.

Figure 8A:
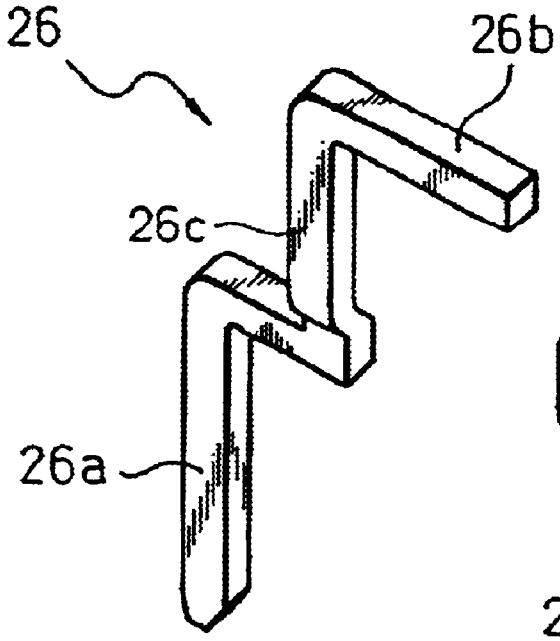
FIG. 8A is a perspective view showing one coil terminal incorporated in the electromagnetic relay of FIG. 1.
Figure 8B:
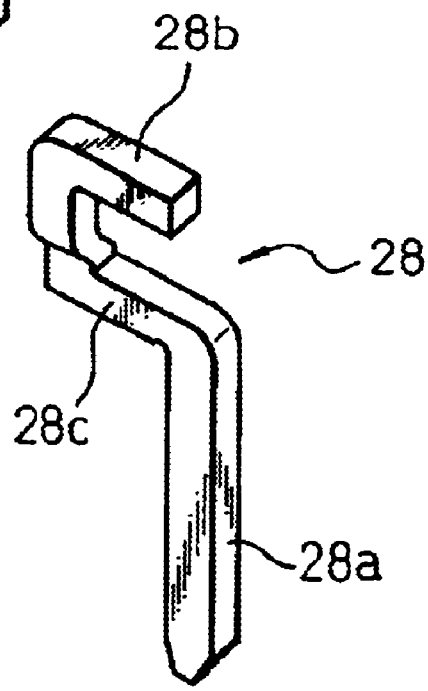
FIG. 8B is a perspective view showing another coil terminal incorporated in the electromagnetic relay of FIG. 1.

As shown in FIGS. 8A and 8B, each of the coil terminals 26, 28 arranged in the electromagnet 14 is provided integrally with the linearly extending first or terminal end region 26*a*, 28*a*, a second or entwining end region 26*b*, 28*b* linearly extending in a direction generally orthogonal to the terminal end region 26*a*, 28*a*, and an intermediate or securing length 26*c*, 28*c* extending in a cranked shape between the terminal end region 26*a*, 28*a* and the entwining end region 26*b*, 28*b*. The coil terminals 26, 28 are formed by, e.g., punching a copper plate into predetermined shapes having thickness generally identical to and length different from each other. In particular, the securing length 26*c* of the coil terminal 26 is longer than the securing length 28*c* of the coil terminal 28, and the entwining end region 26*b* of the coil terminal 26 extends in a certain orientation relative to the terminal end region 26*a*, opposite to the orientation of the connecting end region 28*b* of the coil terminal 28 relative to the terminal end region 28*a*.

Figure 9:
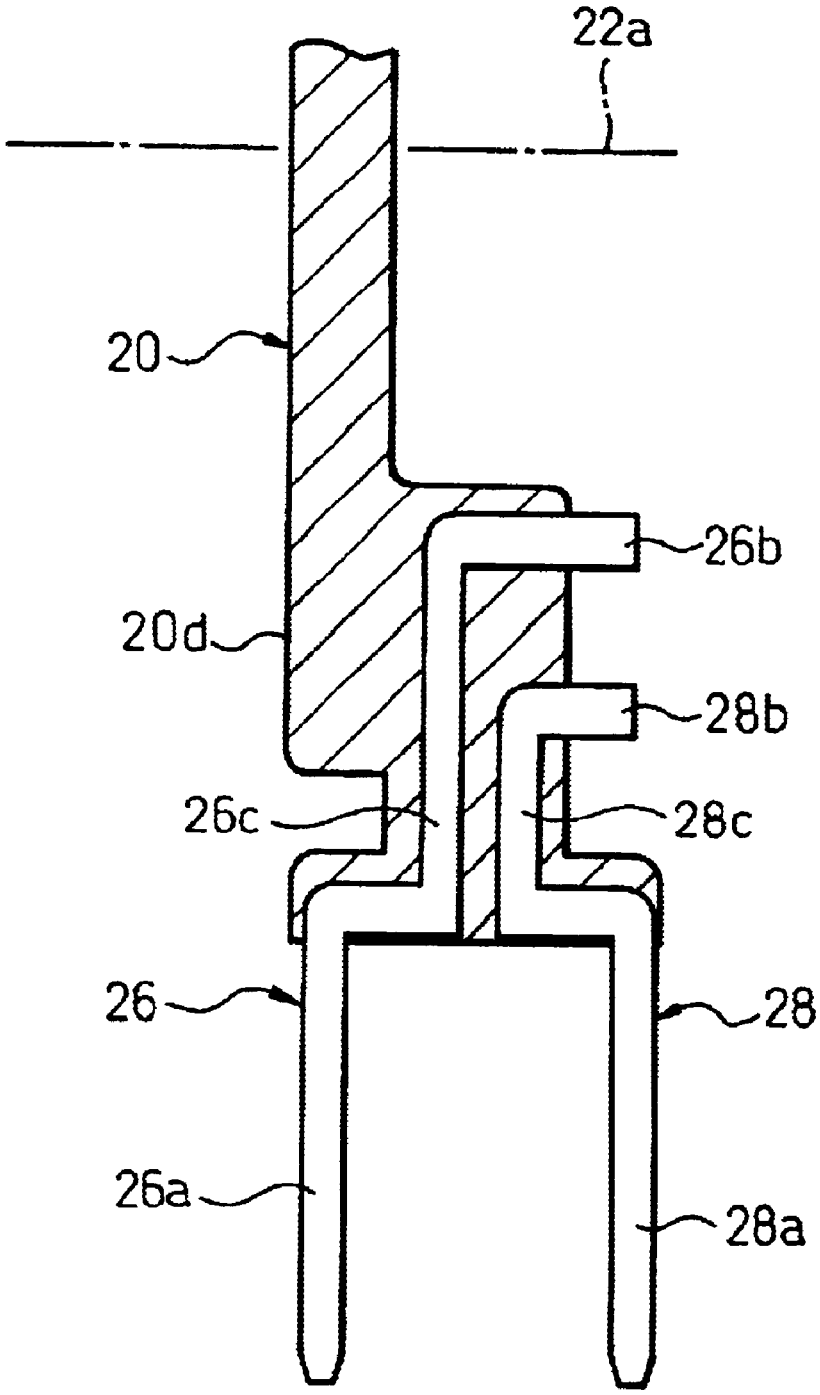
FIG. 9 is a diagrammatic sectional view showing a part of the bobbin, into which coil terminals of FIGS. 8A and 8B are embedded.

The coil terminals 26, 28 having the above configurations are disposed on and fixed to the terminal support 20*d* of the bobbin 20, in such a manner that, as shown in FIGS. 3 and 9, the respective terminal end regions 26*a*, 28*a* extend in a direction generally orthogonal to the center axis 22*a* of the coil 22 so as to project downward from the terminal support 20*d*, and the respective entwining end regions 26*b*, 28*b* extend in a direction generally parallel to the coil center axis 22*a* so as to project axially outward, relative to the coil 22, from the terminal support 20*d*. In this configuration, the entwining end regions 26*b*, 28*b* of the coil terminals 26, 28 are located at accessible positions allowing the wire ends to be readily entwined therewith.

In this regard, if the dimensional restriction is required for the terminal support 20*d* of the bobbin 20, it is advantageous to integrally secure the coil terminals 26, 28 to the terminal support 20*d* through an insert molding process. In the insert molding process, the bobbin 20 is integrally molded in a mold (not shown) in a condition where the separate coil terminals 26, 28 are placed, as an insert, at predetermined locations in the mold, whereby the securing lengths 26*c*, 28*c* of the coil terminals 26, 28 are closely embedded in the terminal support 20*d* of the bobbin 20 and integrally fixed to the terminal support 20*d*. In this manner, the bobbin 20 with the coil terminals 26, 28 secured thereto is provided.

In the condition where the coil terminals 26, 28 are properly mounted to the terminal support 20*d* of the bobbin 20, the terminal end regions 26*a*, 28*a* of the coil terminals 26, 28 are spaced at a predetermined distance from each other and are arranged side-by-side in a row extending substantially parallel to the center axis 22*a* of the coil 22. On the other hand, the entwining end regions 26*b*, 28*b* of the coil terminals 26, 28 are spaced at a predetermined distance from each other and are arranged side-by-side in a row substantially perpendicular to the coil center axis 22*a*. The opposite ends of the conductive wire 30 (FIG. 10) for forming the coil 22 are fixedly connected respectively to the entwining end regions 26*b*, 28*b* of the coil terminals 26, 28 arranged in this manner.

Figure 10:
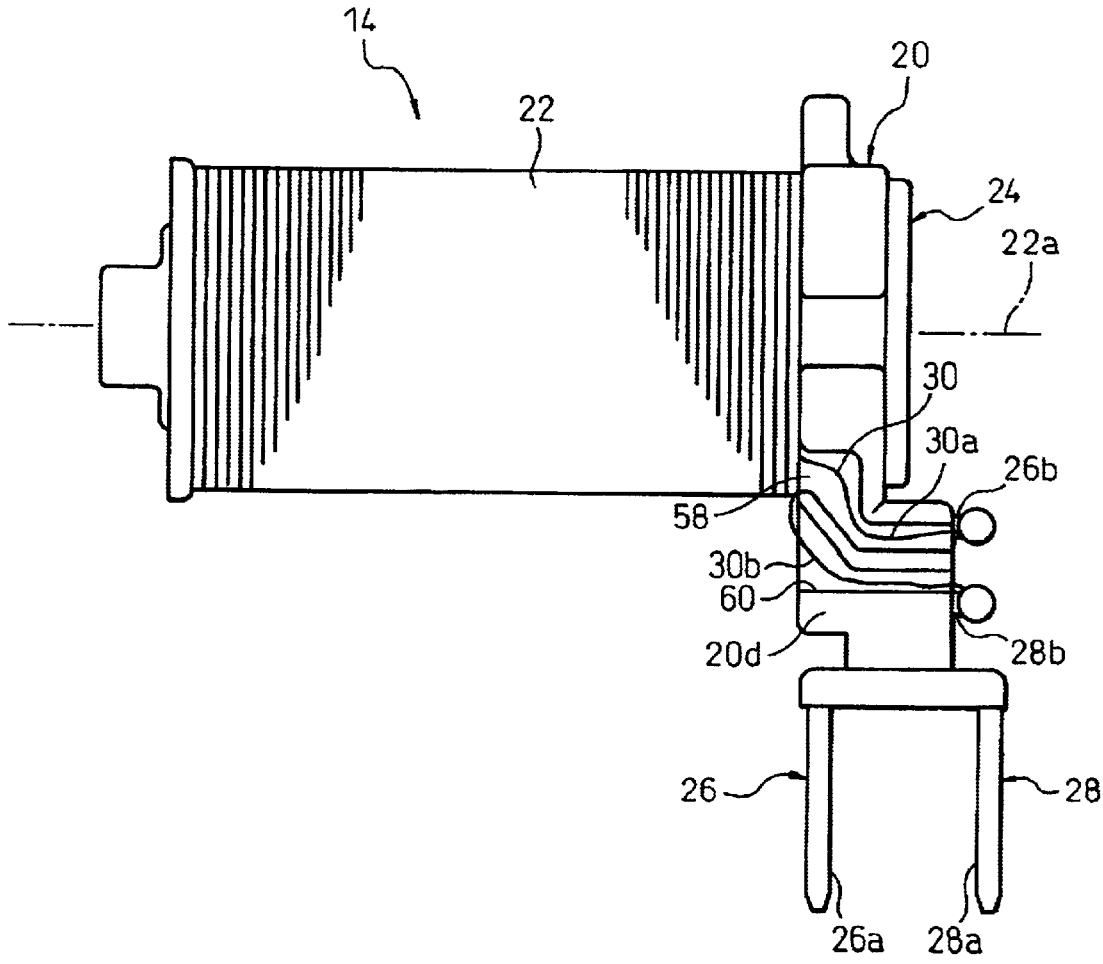
FIG. 10 is a front view showing the electromagnet of FIG. 3.

A winding process for forming the coil 22 on the bobbin 20 in the electromagnet 14 will be described below, with reference to FIG. 10.

As already described, the entwining end regions 26*b*, 28*b* of the coil terminals 26, 28 are previously located so as to project axially outward, relative to the coil 22 formed on the bobbin 20 or to the body 20*a* of the bobbin 20, from the terminal support 20*d* of the bobbin 20 (FIG. 4). This configuration prevents the entwining end regions 26*b*, 28*b* from obstructing the easy and accurate winding process of the conductive wire 30 on the body 20*a* of the bobbin 20.

First, one end of the conductive wire 30 is entwined around the entwining end region 26*b* of the coil terminal 26, located at the accessible position in an upper side in the drawing, so as to be temporarily held thereon. Thereafter, the desired length of the conductive wire 30 is wound around the body 20*a* of the bobbin 20 to form the coil 22. In these steps, a certain leading length 30*a* of the conductive wire 30 extending between the coil 22 and the entwining end region 26*b* is received in a groove 58 formed on the lateral side of the terminal support 20*d* of the bobbin 20.

After the coil 22 is formed, another end of the conductive wire 30 is entwined around the connecting end region 28*b* of the coil terminal 28, located at the accessible position in a lower side in the drawing, so as to be temporarily held thereon. In this step, a certain trailing length 30*b* of the conductive wire 30 extending between the coil 22 and the entwining end region 28*b* is received in a groove 60 formed on the lateral side of the terminal support 20*d* separately from the groove 58. This positional correlation between the opposite ends of the conductive wire 30 prevents the leading and trailing lengths 30*a*, 30*b* of the wire 30 from intersecting and contacting with each other, and thus results in an effective suppression of heat generation in the leading and trailing lengths 30*a*, 30*b* during the operation or excitation of the electromagnet 14.

Finally, the opposite ends of the conductive wire 30, temporarily held on the entwining end regions 26*b*, 28*b* of the coil terminals 26, 28, are fixed through a soldering or arc-welding process to the corresponding entwining end regions 26*b*, 28*b*. In this condition where the conductive wire 30 is completely connected to the coil terminals 26, 28, the entwining end regions 26*b*, 28*b*, arranged to project outward in the axial direction relative to the coil 22, are located so as not to project outward in, especially, the transverse or width direction of the bobbin 20. Therefore, in this condition, it is not necessary to deform the coil terminals 26, 28 to displace the entwining end regions 26*b*, 28*b* in any directions, and the entwining end regions 26*b*, 28*b* are left in the original accessible positions.

As described above, in the electromagnetic relay 10 according to the present invention, the coil terminals 26, 28 are not deformed to displace the entwining end regions 26*b*, 28*b*, to which the opposite wire ends are fixedly connected, in the winding process of the conductive wire 30 for the electromagnet 14 after the wire connection is completed, so that it is possible to simplify the winding process and thereby significantly eliminating the possibility of breakage of the coil wire, probably caused in the leading and trailing lengths 30*a*, 30*b* of the wire 30 extending between the coil 22 and the coil terminals 26, 28. In this respect, the entwining end regions 26*b*, 28*b* of the coil terminals 26, 28, to which the opposite wire ends are fixedly connected, are located so as not to project outward in, especially, the transverse or width direction of the bobbin 20, so that it is possible to meet the requirements of a dimensional restriction in, especially, the transverse or width direction of the electromagnetic relay 10. Further, an arc welding may be effectively adopted for fixing the wire ends to the entwining end regions 26*b*, 28*b*, so that it is possible to meet the general requirements of reduction of solder in manufacturing processes. Accordingly, the electromagnetic relay 10 is capable of being manufactured at low cost and in an ecological sound way, and of possessing a good operational reliability, while facilitating the reduction in thickness or width dimension of the relay 10.

It is also desired that the coil terminals 26, 28 are shaped and dimensioned in such a manner that, in a state where the coil terminals 26, 28 are properly mounted to the terminal support 20*d* of the bobbin 20, both of the entwining end regions 26*b*, 28*b* do not extend axially outward relative to the coil 22 over the line of the terminal end region 28*a* of the coil terminal 28 (see FIG. 9). In this arrangement, the electromagnetic relay 10 is capable of meeting the requirements of a dimensional restriction in the axial direction of the coil 22 in addition to the width direction, which facilitates the further reduction in the entire dimension of the relay 10.

The electromagnetic relay 10 according to the invention may adopt an assembled structure wherein the electromagnet 14 and the magnetic-circuit assembly are secured to the base 12 by mounting the yoke 32 joined with the electromagnet 14 to the base 12 in a press-fitting manner. This structure effectively contributes to the reduction in thickness or width dimension of the relay 10. In particular, the electromagnetic relay 10 as illustrated adopts a characteristic arrangement, as described below, for significantly eliminating the degradation of magnetic attraction force of the electromagnet 14 while ensuring the sufficient mount strength of the yoke 32 to the base 12.

Figure 11A:
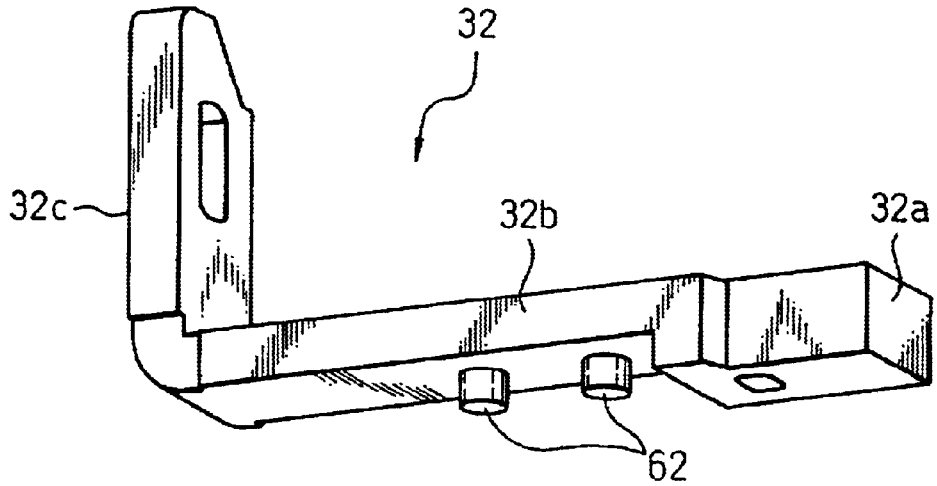
FIGS. 11A and 11B are perspective views showing a yoke incorporated in the electromagnetic relay of FIG. 1.
Figure 11B:
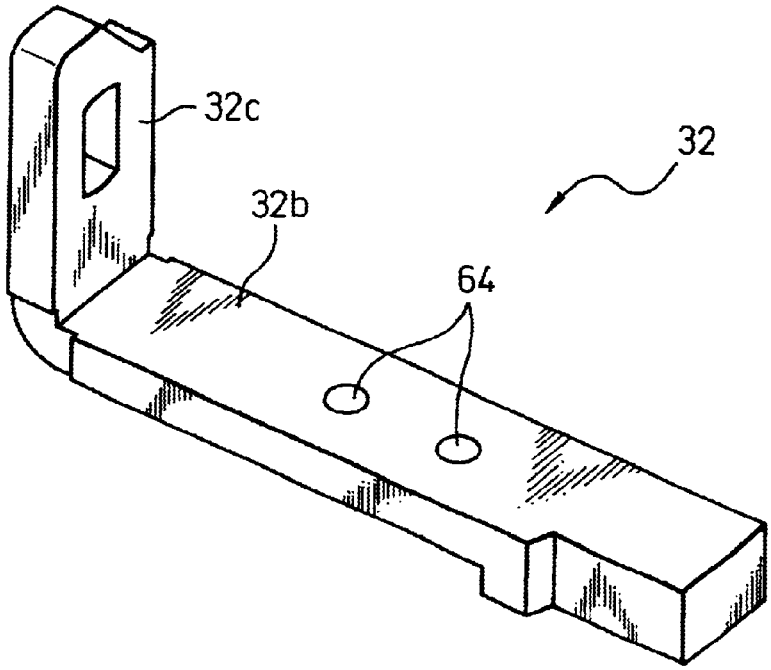
Figure 12:
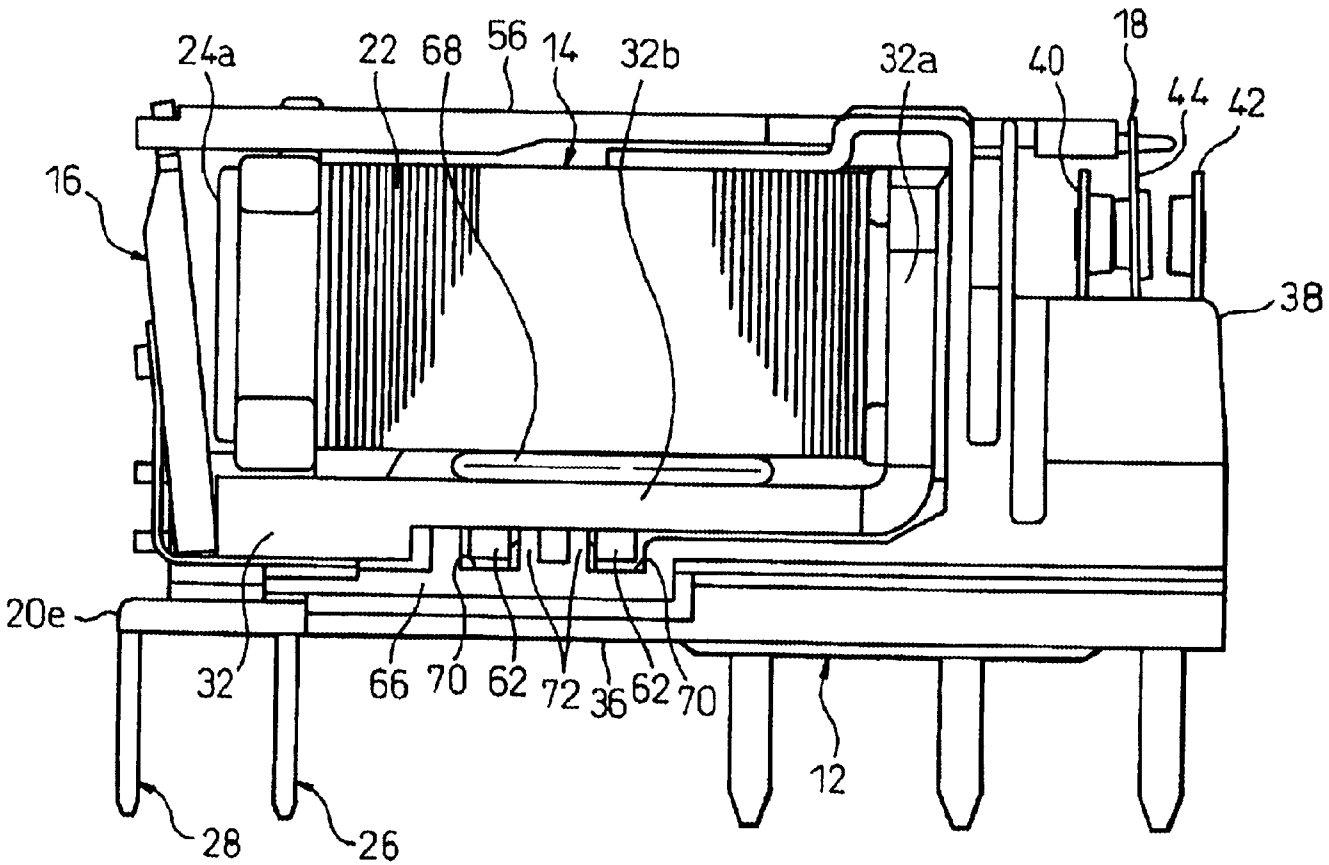
FIG. 12 is a front view showing the electromagnetic relay of FIG. 1.

As shown in FIG. 11A, the yoke 32 is provided in the generally center area of the longer length part 32*b* with a pair of protrusions 62 protruding from the lower side of the longer length part 32*b* in a direction opposite to the shorter length part 32*c*. The protrusions 62, each having a generally cylindrical shape, are spaced from each other at a predetermined distance in the longitudinal direction of the longer length part 32*b*. Also, as shown in FIG. 11B, the longer length part 32*b* of the yoke 32 may be provided in an upper side thereof with a pair of cylindrical recesses 64 formed at positions corresponding to the protrusions 62.

On the other hand, referring again to FIG. 7, the base 12 is provided in the first portion 36 with a bottom wall 66 extending in a horizontal direction generally orthogonal to the lateral face of the insulating wall 52, and a holding wall 68 extending in the horizontal direction above the bottom wall 66 and spaced from the bottom wall 66 at a predetermined distance. The bottom wall 66 is provided with a pair of grooves 70 opposed to the holding wall 68. The grooves 70 linearly extend perpendicularly to the lateral face of the insulating wall 52, and are dimensioned to be capable of respectively receiving the protrusions 62 of the yoke 32 in a slidable manner. A pair of spaced ridges 72 are formed between the grooves 70 so as to linearly extend perpendicularly to the lateral face of the insulating wall 52.

The distance between the bottom and holding walls 66, 68 of the base 12 corresponds to the thickness of the longer length part 32*b* of the yoke 32. As a result, the yoke 32 is received at the longer length part 32*b* generally tightly within a space between the bottom and holding walls 66, 68 of the base 12, so as to be held therebetween in a stable condition. Moreover, the ridges 72 formed on the bottom wall 66 have outside end faces opposite to each other, the distance between the outside end faces corresponding to the distance between the protrusions 62 formed on the yoke 32. In particular, the ridges 72 of the bottom wall 66 are preferably shaped and dimensioned so as to be held between the protrusions 62 of the yoke 32 under a certain pressure.

In the assembling process of the electromagnet 14 and the magnetic-circuit assembly to the base 12, the longer length part 32*b* of the yoke 32 joined to the electromagnet 14 is inserted into the space between the bottom and holding walls 66, 68 of the base 12 in a lateral direction relative to the base 12, and simultaneously the protrusions 62 of the yoke 32 are inserted within the grooves 70 of the bottom wall 66 in the lateral direction. During this process, the ridges 72 of the bottom wall 66 are received and press-fitted into a space between the protrusions 62 of the yoke 32. When the electromagnet 14 and the magnetic-circuit assembly are continued to be inserted or urged toward the insulating wall 52 of the base 12, the protrusions 62 of the yoke 32 are guided along the ridges 72 of the bottom wall 66, whereby the electromagnet 14 and the magnetic-circuit assembly are assembled in a proper position on the first portion 36 of the base 12. In this condition, the longer length part 32*b* of the yoke 32 is fixed in the press-fitted manner between the bottom and holding walls 66, 68 of the base 12, so that the electromagnet 14 and the magnetic-circuit assembly are firmly and securely held on the base 12.

In the above-described arrangement, the yoke 32 forming a magnetic path is provided with the protrusions 62 for a press-fitting operation, which prevents the cross-sectional area of the yoke 32 from being locally reduced, so that it is possible to suppress the degradation of magnetic attraction force of the electromagnet 14 due to the decrease of magnetic flux. The mount strength of the electromagnet 14 and the magnetic-circuit assembly relative to the base 12 is maintained by ensuring the necessary and sufficient dimensions of the protrusions 62 and the ridges 72. Accordingly, the electromagnetic relay 10 possesses stable operating characteristics and high structural reliability. It should be noted that the above-described press-fitting arrangement of the yoke may be applied to the other various types of electromagnetic relays which do not include the characteristic arrangement of coil terminals as described in the illustrated embodiment.

When the electromagnet 14 and the magnetic-circuit assembly are properly mounted to the base 12, the bottom wall 20*e* of the bobbin 20 of the electromagnet 14 comes into engagement with the bottom wall 66 of the first portion 36 of the base 12 along outer peripheries thereof, so as to define a substantially flat bottom surface of the electromagnetic relay 10. In this state, the terminal end regions 26*a*, 28*a* of the coil terminals 26, 28 in the electromagnet 14 are aligned with the terminal end regions 40*a*, 42*a*, 44*a* of the fixed and movable contact plate 40, 42, 44 in the contact section 18, in a row extending substantially parallel to the coil center axis (see FIGS. 1 and 2). This arrangement effectively contributes to the reduction in thickness or width dimension of the electromagnetic relay 10. When a rectangular box-shaped case (not shown) is attached to cover the magnetic relay 10 and is joined to the bobbin bottom wall 20*e* and the base bottom wall 66, an end product is completed.

While the invention has been particularly shown and described with reference to preferred embodiments thereof, it will be understood by those skilled in the art that various changes and modifications may be made without departing from the spirit and scope of the following claims.

What is claimed is:

1. An electromagnetic relay comprising:

a base;

an electromagnet incorporated to said base;

an armature movably arranged relative to said electromagnet; and a contact section incorporated to said base to be actuated by said armature;

said electromagnet including a bobbin, a coil having a center axis and carried on said bobbin, and a pair of coil terminals mounted to said bobbin;

each of said coil terminals being provided with a first end region and a second end region, extending in respective directions transverse to each other;

said coil terminals being disposed in such a manner that respective first end regions extend in a direction transverse to said center axis of said coil to project outward from said bobbin and are arranged side-by-side in a row extending substantially parallel to said center axis, and that respective second end regions extend in a direction parallel to said center axis of said coil to project outward from said bobbin and are arranged side-by-side in a row extending substantially transverse to said center axis; opposite wire ends of said coil being connected respectively to said second end regions.

2. An electromagnetic relay as set forth in claim 1, wherein each of said coil terminals is further provided with an intermediate length extending between said first and second end regions, said intermediate length being closely embedded in and integrally fixed to said bobbin.

3. An electromagnetic relay as set forth in claim 1, wherein said coil terminals have lengths different from each other.

4. An electromagnetic relay as set forth in claim 1, wherein said second end regions of said coil terminals extend in respective orientations opposite to each other in relation to corresponding first end regions.

5. An electromagnetic relay as set forth in claim 1, wherein said first and second end regions of said coil terminals extend in respective directions orthogonal to each other.

6. An electromagnetic relay as set forth in claim 1, wherein said contact section includes a fixed contact plate and a movable contact plate; said fixed contact plate and said movable contact plate being provided respectively with end regions extending in a direction transverse to said center axis of said coil to project outward from said base; said end regions of said fixed and movable contact plates being arranged side-by-side in a row extending substantially parallel to said center axis and aligned to said row of said first end regions of said coil terminals.

7. An electromagnetic relay as set forth in claim 1, wherein said electromagnet further includes an iron core received in said bobbin and disposed along said center axis of said coil, and wherein said electromagnetic relay further comprises a yoke securely joined to said iron core to form a magnetic path around said coil; said yoke being provided with a protrusion tightly engaged with said base; said electromagnet being fixedly mounted to said base through an interengagement of said protrusion with said base in a press-fitting manner.

8. An electromagnetic relay comprising:

an electromagnet including a bobbin, a coil having a center axis and carried on said bobbin, and a pair of coil terminals mounted to said bobbin;

each of said coil terminals being provided with a first end region and a second end region, extending in respective directions transverse to each other;

said coil terminals being disposed in such a manner that respective first end regions extend in a direction transverse to said center axis of said coil to project outward from said bobbin and are arranged side-by-side in a row extending substantially parallel to said center axis, and that respective second end regions extend in a direction parallel to said center axis of said coil to project outward from said bobbin and are arranged side-by-side in a row extending substantially transverse to said center axis; opposite wire ends of said coil being connected respectively to said second end regions.

* * * * *